US006343985B1

(12) United States Patent
Smith

(10) Patent No.: US 6,343,985 B1
(45) Date of Patent: Feb. 5, 2002

(54) ROOF RIDGE VENTILATOR SYSTEM OF NATURAL FIBER MATTING

(75) Inventor: Douglas A. Smith, Dallas, TX (US)

(73) Assignee: Blocksom & Co., Michigan City, IN (US)

( * ) Notice: Subject to any disclaimer, the term of this patent is extended or adjusted under 35 U.S.C. 154(b) by 0 days.

(21) Appl. No.: 09/483,099

(22) Filed: Jan. 14, 2000

(51) Int. Cl.[7] ..... F24F 7/02
(52) U.S. Cl. ..... 454/365; 52/83; 52/199
(58) Field of Search ..... 454/365, 367; 52/95, 91.3

(56) References Cited

U.S. PATENT DOCUMENTS

| | | | | | |
|---|---|---|---|---|---|
| 4,325,290 | A | | 4/1982 | Wolfert | |
| 4,498,262 | A | * | 2/1985 | Garcia | 52/173 R |
| 4,942,699 | A | | 7/1990 | Spinelli | 52/57 |
| 5,122,095 | A | | 6/1992 | Wolfert | 454/365 |
| 5,167,579 | A | | 12/1992 | Rotter | 454/365 |
| 5,332,393 | A | * | 7/1994 | Godl | 454/365 |
| 5,425,672 | A | | 6/1995 | Rotter | 454/365 |
| 5,934,995 | A | | 8/1999 | Morris et al. | 454/365 |
| 5,960,595 | A | | 10/1999 | McCorsley, III et al. | 52/199 |
| 5,996,289 | A | * | 12/1999 | Allaster | 52/95 |

* cited by examiner

*Primary Examiner*—Harold Joyce
*Assistant Examiner*—Derek S. Boles
(74) *Attorney, Agent, or Firm*—Jenner & Block, LLC

(57) ABSTRACT

An improved roof ridge ventilation system utilizing a mat of randomly-aligned natural fibers which formed into a web by air-laying on a polyester mesh and bonded with a heat-cured latex bonding agent. The natural fiber mat provides improved airflow while excluding water, dust and pests such as insects and rodents and is more economical that competing materials. The mat is conveniently manufactured in rolls for ease of transport and installation.

2 Claims, 1 Drawing Sheet

ROOF RIDGE VENTILATOR SYSTEM OF NATURAL FIBER MATTING

FIELD OF THE INVENTION

The invention relates generally to the field of roof ventilation systems, and more particularly to roof ridge ventilation systems using a matting material.

BACKGROUND OF THE INVENTION

It has long been a common practice to provide ventilation to attics under gable roofs by installing a vent along the ridge of the roof. A slot or space is provided in the sheeting and roofing materials adjacent to each side of the ridge and extending along the length of the ridge. The slot allows hot air to escape by convection as well as by the suction created by wind blowing over the roof ridge.

To further enhance ventilation, soffit ventilators are typically installed under the eaves of an overhanging roof. Additional ventilators may be installed in the gable ends of the building. Fresh air from outside the structure enters the attic through perforations or slots in the soffit and gable ventilators. The entering fresh air tends to equalize the temperature and pressure of the air inside the attic with the ambient air outside the structure. This equalization reduces condensation of water vapor on the inside surfaces of the attic, thus reducing the formation of mildew and rot in the structure. Removal of the hot air from the attic also reduces the cost of air conditioning the building below the attic.

The roof ridge vent thus works in combination with soffit and gable vents to enable passive air ventilation. The exit of heated, stale air through the ridge vent by convection and wind suction is accompanied by the entry of fresh, cooler outside air through the soffit and gable vents.

The ridge vent must be capped to prevent entry of water from rain or snow, and preferably must also have some means to exclude dust and pests such as insects, birds and rodents. The simplest type of cap that has long been used is a metal hood spaced above the ridge slot and extending wider than the slot to exclude water. The metal hood may also include metal baffles, louvers or screens to exclude pests.

Other known cap structures utilize a porous material over the slot which permits the passage of air but excludes pests. The porous material is topped with the same roofing material as the rest of the roof, e.g., asphalt shingles. Materials which have been used include matrices of molded plastic, corrugated polyethylene sheets, open-cell plastic foam and various synthetic fiber materials such as nylon or polyester. These materials each have certain desirable properties, but also suffer from disadvantages such as lack of durability, inconvenient installation requirements and high cost.

SUMMARY OF THE INVENTION

It is an object of the invention to provide an improved roof ridge ventilation system using a mat made of randomly-aligned natural fibers laid on a polyester mesh fabric and joined by latex binding agents and heat cured to form a mat with varying mesh.

It is also an object of the invention to provide a mat that may be produced in rolls which are lightweight and easy to transport, and are easily installed by unrolling the mat along the length of the slot in the roof ridge, covering with cap shingles and fastening the shingles to the roof with standard roofing nails. Strips of the mat may be joined end-to-end to provide a continuous strip long the entire length of the roof ridge by using caulk to seal the ends of the strips together.

It is a further object of the invention to provide a roof ridge vent system which provides maximum flow of air while providing an effective barrier to water, dust and pests.

It is yet another object of the invention to provide an aesthetically-pleasing roof ridge vent.

It is a further object of the invention to provide a roof ridge vent system using a mat material which is more economical than synthetic mat materials.

DESCRIPTION OF THE PREFERRED EMBODIMENT

Figure 1:
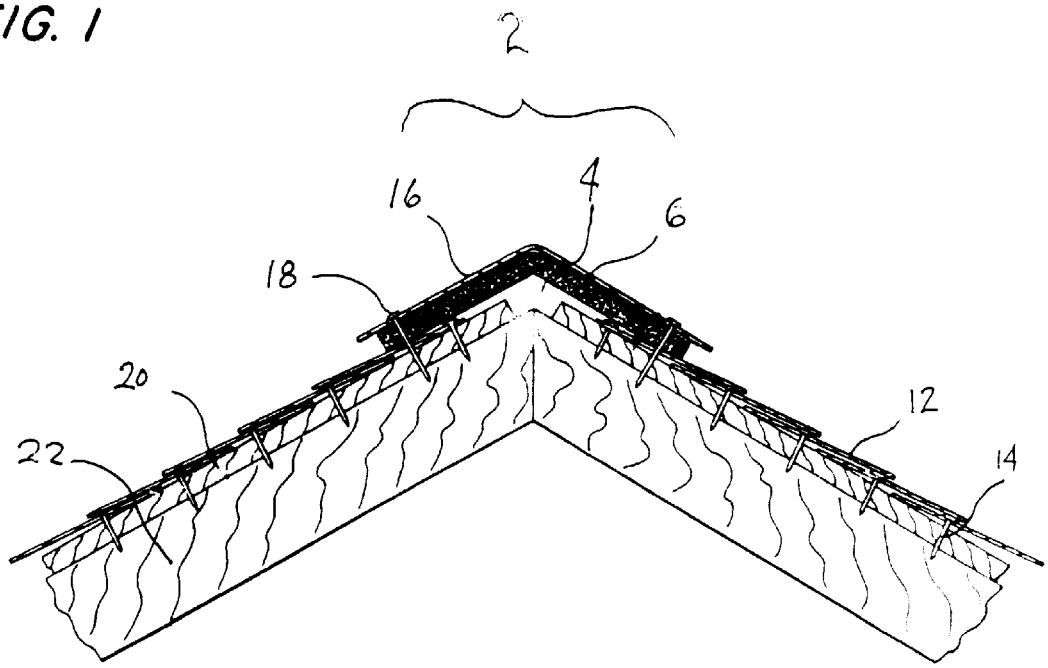
FIG. 1 is a cross-section view of a roof ridge vent showing the mat of the invention.

As shown in FIG. 1, the roof ridge venting system 2 includes a slot 4 in the ridge of a roof above the attic of a building. Slot 4 may be formed during the original construction of the building or may be added to an existing building. The dimensions of slot 4 will vary depending on the type of framing and roof construction, but will typically be in the range of ¾ to 2 inches on each side of the ridge. Hot air inside the attic rises and is drawn out the vent opening at the peak of the roof by convection. In addition, wind blowing across the roof creates a lower pressure region at the vent opening which also serves to draw air out of the vent.

The system preferably also includes conventional soffit vents installed under the eaves of an overhanging roof, and may also include conventional vents in the gable ends of the structure. The soffit and gable vents, which may be louvered or screened, are widely used to admit fresh air to the attic. The entering fresh air tends to equalize the temperature and pressure of the air inside the attic with the ambient air outside the structure. This equalization reduces condensation of water vapor on the inside surfaces of the attic, thus reducing the formation of mildew and rot in the structure. Removal of the hot air from the attic also reduces the cost of air conditioning the building below the attic.

The roofridge vent 2 thus works in combination with the soffit and gable vents to enable passive air ventilation. The exit of heated, stale air through the ridge vent 2 by convection and wind suction is accompanied by the entry of fresh, cooler outside air through the soffit and gable vents.

The ridge vent must be capped to prevent entry of water from rain or snow, and preferably must also have some means to exclude dust and pests such as insects, birds and rodents. Ideally, the cap should be designed to perform these functions while simultaneous providing as little interference as possible with the flow of air through the vent. A basic type of cap that has long been used is a metal hood spaced above the ridge slot and extending wider than the slot to exclude water. The metal hood may also include metal baffles, louvers or screens to exclude pests. Such metal caps, while fairly effective at excluding water, generally are ineffective at excluding dust and are relatively expensive and difficult to install. They may also detract from the aesthetics of the roof design.

The system of the invention provides maximum airflow and an effective barrier to water, dust and pests. It is easy to install, durable, less expensive than competing vent systems, and aesthetic in appearance. The invention achieves these desired effects by using a porous mat 6 of natural fiber materials to exclude water, dust and pests.

Figure 2:
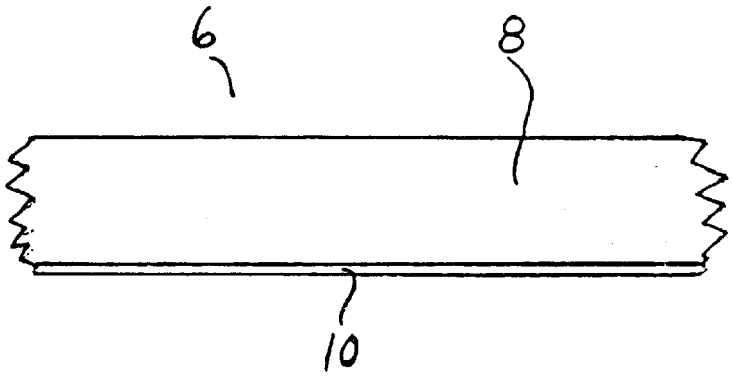
FIG. 2 is a cross-section view of a mat of natural fibers air-layed on a synthetic mesh fabric in accordance with the invention.

As shown in FIG. 2, mat 6 is made of a non-woven, natural fiber web 8 of a type that has been used in other applications for air filters and packaging media, preferably coir fibers blended with animal hair. Coir fibers are opened and mixed with sterilized animal hair, then randomly aligned onto a polyester mesh fabric 10 by means of an air-lay assembly to create a web 8. The web 8 is then sprayed with a water-based latex binding agent. The web 8 is then cured in an oven to bind the fibers into a relatively rigid mat 6 having a significant porosity between the fibers.

The cured web 8 is passed through a horizontal rotating knife assembly to trim excess fiber from the top side of the web 8 to produce a more uniform thickness of approximately 1 inch. The web 8 is then sprayed with a second coating of binding agents and again passed through an oven to cure the binding agent and secure the fibers. The fully-cured web 8 then passes through knives to slit the material to the desired width. A horizontal shear cuts across the width of the web 8 and the material is rolled in preparation for packaging.

As shown in FIG. 1, the ridge vent system 2 includes a mat 6 of the material previously described. The mat 6 extends the length of slot 4, overlapping slot 4 on each side. Conventional roof shingles 12 are laid in overlapping rows and fastened with standard roofing nails 14 up to slot 4. The mat 6 is readily installed by simply unrolling it into position over the slot 4 and cutting it to the desired length. If the ridge is of such length as to require more than a single roll of mat material, additional lengths of mat material may be joined by abutting the ends of the strips and sealing them together with caulk or roofing compound. Cap shingles 16 of the same color and finish as roof shingles 12 are installed on top of the mat and secured by driving longer roofing nails 18 through the cap shingles 16, mat 6 and roof shingles 12 into the roof sheeting (plywood) 20 and rafters 22 of the roof.

The relatively thin dimension of the mat 6 and the fact that cap shingles 16 match the roof shingles 12 make the ridge vent system 2 visually blend into the roof as a whole, eliminating an unsightly vent and providing an aesthetic appearance.

The bonded natural fiber mat 6 is non-wicking and provides an effective barrier against precipitation. The material provides adequate resistance to compression so as to furnish a sound structural base to the cap shingles 16. The mat material resists degradation from sunlight and is resistance to damage from vermin.

Airflow through the mat 6 has been found to be superior to airflow through known mats of synthetic fibers such as nylon or polyester. Moreover, the mat 6 comprising natural fibers air-layed onto a synthetic mesh fabric may be manufactured at a cost that is significantly less than that of mats of synthetic fibers. Preliminary tests also indicate that the material offers functional advantages over mats of synthetic fibers, including superior net free vent area and air permeability.

While particular embodiments of the invention has been described above, it will be understood by those skilled in the art that the invention is not limited to the disclosed embodiments, and many variations and modifications may be made which will not depart from the spirit of the invention, whose scope is limited only by the following claims.

I claim:

1. A roof ventilation system comprising:

an open slot extending the length of a roof ridge;

a resilient and air-permeable mat covering the slot and extending the length of the slot, said mat being formed of randomly-aligned natural coir fibers that have been opened and blended with sterilized animal hair, coated with a latex bonding agent and heat cured to a synthetic backing sheet; and a cap comprising roofing material covering the mat and spaced above the roof ridge by the thickness of the mat to provide air ventilation through the mat.

2. The system of claim 1 wherein the mat acts as a barrier to exclude the entry of water, dust and pests.

* * * * *